United States Patent [19]

Greene et al.

[11] Patent Number: 4,602,952

[45] Date of Patent: Jul. 29, 1986

[54] PROCESS FOR MAKING A COMPOSITE POWDER METALLURGICAL BILLET

[75] Inventors: Robert L. Greene, Ann Arbor, Mich.; James R. Becker, Houston, Tex.

[73] Assignee: Cameron Iron Works, Inc., Houston, Tex.

[21] Appl. No.: 726,309

[22] Filed: Apr. 23, 1985

[51] Int. Cl.[4] ..... B22F 7/00

[52] U.S. Cl. ..... 75/228; 419/6; 419/38; 419/39; 419/42; 419/49; 72/272; 148/126.1; 148/127

[58] Field of Search ..... 419/5-9, 419/67, 68, 38, 42, 49, 39; 148/126.1, 127; 72/272; 75/228

[56] References Cited

U.S. PATENT DOCUMENTS

| | | | |
|---|---|---|---|
| 3,056,190 | 10/1962 | Chisholm et al. | 419/8 |
| 3,409,973 | 11/1968 | Kilp et al. | 419/8 |
| 3,780,418 | 12/1973 | Hurst | 419/6 |
| 3,803,702 | 4/1974 | Bratt et al. | 419/8 |
| 3,823,463 | 7/1974 | Weaver et al. | 29/417 |
| 3,824,097 | 7/1974 | Smythe et al. | 75/226 |
| 3,893,852 | 7/1975 | Bergman et al. | 75/224 |
| 3,922,769 | 12/1975 | Brenan | 29/420.5 |
| 4,040,162 | 8/1977 | Isogai et al. | 29/420.5 |
| 4,059,896 | 11/1977 | Asari et al. | 29/403 |
| 4,090,873 | 5/1978 | Takamura et al. | 419/8 |
| 4,131,461 | 12/1978 | De Pierre et al. | 75/208 |
| 4,260,582 | 4/1981 | Kumar et al. | 264/111 |
| 4,297,777 | 11/1981 | Kucza et al. | 419/8 |
| 4,410,488 | 10/1983 | Gessinger et al. | 419/48 |
| 4,447,390 | 5/1984 | Rozmus | 419/49 |

*Primary Examiner*—Stephen J. Lechert, Jr.

*Attorney, Agent, or Firm*—Harness, Dickey & Pierce

[57] ABSTRACT

A process for producing a composite billet employing powder metallurgical techniques in which a first alloy powder of a preselected composition is compacted in a tubular container producing a preliminarily compacted tubular mass which thereafter is finished on the interior surface thereof to desired final dimensions. The resultant tubular mass is placed in a second container and the core thereof is filled with a powder of a desired second alloy composition and the contents are sealed. The second alloy powder is subsequently hot compacted to a density approaching 100 percent theoretical density without incurring any appreciable distortion or dimensional change of the tubular mass. Thereafter, the preliminary composite compacted billet is subjected under elevated temperature to an axial extrusion step producing a final composite extruded billet having a concentric outer layer of a first alloy and an inner core layer of a second alloy metallurgically bonded together.

13 Claims, 5 Drawing Figures

PROCESS FOR MAKING A COMPOSITE POWDER METALLURGICAL BILLET

BACKGROUND OF THE INVENTION

The present invention broadly relates to a process for producing a compact billet employing powder metallurgical techniques, and more particularly, a process for producing an elongated densified billet comprised of at least two different alloy compositions metallurgically bonded at their interface including a peripheral outer section and an inner central and axially extending core substantially concentric to each other.

A variety of metal alloys are characterized as having a metallurgical structure in the as-cast condition which renders them extremely difficult to postform to a desired final shape employing conventional forming techniques such as forging or the like. Typical of such metal alloys are the so-called nickel-based superalloys which are generally characterized as having carbide strengthening and gamma prime strengthening in their case and wrought forms containing relatively large quantities of second phase gamma prime and complex carbides in a nickel-chromium gamma matrix. This metallurgical structure contributes to the excellent high temperature physical properties of such alloys but also renders ingots cast from such alloys difficult to postform and rendering them susceptible to macrosegregations resulting in cast billets which are of nonuniform microstructure and possessed of less than optimum physical properties.

Because of the foregoing, powdered metallurgical techniques have now been adopted whereby such alloys are microcast or atomized into a powder of the selected particle size which thereafter is consolidated under high pressre and elevated temperatures into a dense mass approaching 100 percent theoretical density. The resultant densified metallurgical billet is of uniform composition and microstructure.

In the fabrication of rotary components subject to high temperatures under high stress conditions such as gas turbine discs, for example, the desired physical and chemical properties of the outer peripheral portion of the disc defining the blade sections and/or blade attachment section is desirably different from those of the inner or hub section to achieve optimum performance and durability. The blade section of gas turbine discs preferably is comprised of an alloy composition and microstructure which provides for high temperature tensile strength, high temperature creep strength and good corrosion resistance. On the other hand, the central hub section of such turbine discs which are exposed to lower temperatures during service is desirably possessed of high tensile strength, good low cycle fatigue and good crack-growth resistance. The fabrication of a gas turbine disc from a billet which is of substantially uniform composition and microstructure throughout necessitates a compromise between the desired characteristics of the blade section and the hub section to provide a final integral turbine disc possessed of satisfactory performance and durability.

The process of the present invention overcomes the problems and disadvantages as hereinabove set forth by which a composite billet is produced employing powder metallurgical techniques such that selected annular sections thereof are of controlled different alloying composition and/or microstructure thereby optimizing the performance, strength and durability of rotary components fabricated therefrom and providing distinct cost savings and improved performance over similar rotary components comprised of assembled sections of parts composed of different alloy compositions.

SUMMARY OF THE INVENTION

The benefits and advantages of the present invention are achieved by a process in which a composite billet is produced employing powder metallurgical techniques including an outer annular layer of a first alloy composition and an inner cylindrical core of a selected different second alloy composition which are metallurgically bonded to each other in the form of an integral densified mass. In accordance with the process aspects of the invention, a first metal powder of a first alloy composition is confined in a cylindrical container having an axial bore therethrough which is sealed and subsequently hot compacted by hot isostatic pressing or by extrusion to produce a densified tubular mass having a central bore therethrough. All or portions of the container are thereafter removed from the densified tubular mass and the interior bore is preferably finished to desired dimensions by any one of a variety of mechanical finishing techniques. Thereafter, the resultant tubular mass one section thereof is enclosed in a second container and the interior of the central bore is filled with a second metal powder of a desired and different second alloy composition. The container is subsequently sealed and the second metal powder is compacted at elevated temperature under conditions which do not significantly distort or alter the dimensions of the densified tubular mass. The resultant composite preliminary billet is thereafter heated to an elevated temperature and is subsequently extruded at an extrusion ratio generally greater than about 3 to 1 forming an elongated integral billet of substantially 100 percent density and of a wrought grain structure. The container is subsequently removed from the exterior of the composite billet which can thereafter be cut into discs and subsequently postformed and/or machined to a part such as a turbine disc of the desired configuration and size.

It will be appreciated that while the description of the process herein places primary emphasis on the production of billets comprised of two separate superalloys, it is also contemplated that alternative alloy compositions can be employed for producing composite billets containing not only two annular alloy layers but three or more alloy layers metallurgically united together consistent with the desired properties of components to be fabricated therefrom.

Additional benefits and advantages of the present invention will become apparent upon a reading of the Description of the Preferred Embodiments taken in conjunction with the accompanying drawings.

DESCRIPTION OF THE PREFERRED EMBODIMENTS

Figure 1:
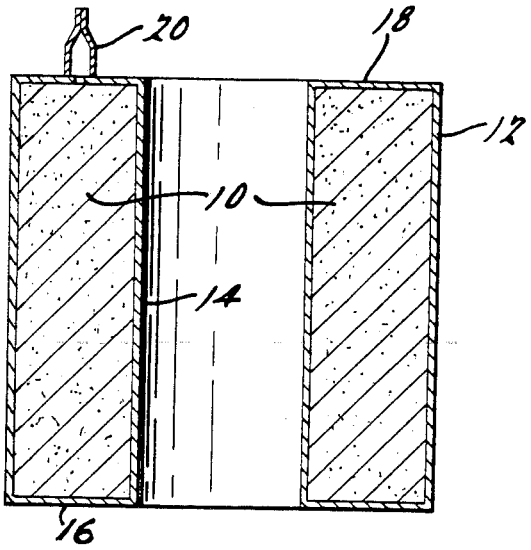
FIG. 1 is a transverse vertical sectional view through a container filled with a first alloy powder which is subjected to hot isostatic compaction to form a tubular billet.

The process of the present invention for producing composite billets by powder metallurgical techniques comprised of two or more alloys of controlled composition is particularly applicable, but not necessarily restricted to nickel-based superalloys suitable for use in the fabrication of rotary components such as turbine discs employed in the compressor section and turbine section of gas turbine engines or the like. It will be appreciated that the present process can be advantageously employed for producing compacted composite billets of powdered materials of alternative composition including metals, metal alloys, intermetallic compounds, nonmetallic compounds and the like which are available in a finely particulated powder form. In the production of composite billets suitable for use in the fabrication of gas turbine disc, typical superalloy compositions which can be satisfactorily employed for the blade section of the turbine disc are set forth in Table 1. Typical superalloy compositions which are desirably employed in the hub section of such turbine discs are set forth in Table 2.

TABLE 1

TYPICAL BLADE SECTION ALLOYS

| Alloy (a) | C | Mn | Si | Cr | Ni | Co | Mo | W | Cb | Ti | Al | B | Zr | Fe | Other |
|---|---|---|---|---|---|---|---|---|---|---|---|---|---|---|---|
| | | | | Nominal Composition, % | | | | | | | | | | | |
| Alloy 713C(c) | 0.12 | — | — | 12.5 | Bal | — | 4.2 | — | 2.0 | 0.8 | 6.1 | 0.012 | 0.10 | — | — |
| Alloy 713L(c) | 0.05 | — | — | 12.0 | Bal | — | 4.5 | — | 2.0 | 0.6 | 5.9 | 0.01 | 0.10 | — | — |
| IN-162(c) | 0.12 | 0.10(b) | 0.20(b) | 10 | Bal | — | 4.0 | 2.0 | 1.0 | 1.0 | 6.5 | 0.020 | 0.10 | 0.50(b) | 2.0 Ta |
| IN-643(c) | 0.50 | — | — | 25.0 | Bal | 12.0 | 0.5 | 9.0 | 2.0 | 0.25 | — | — | 0.25 | 3.0 | — |
| IN-792(c) | 0.21 | — | — | 12.7 | Bal | 9.0 | 2.0 | 3.9 | — | 4.2 | 3.2 | 0.02 | 0.10 | — | 3.9 Ta |
| MAR-M200(c) | 0.15 | — | — | 9.0 | Bal | 10 | — | 12.5 | 1.8 | 2.0 | 5.0 | 0.015 | 0.05 | — | — |
| MAR-M421(c) | 0.15 | 0.20(b) | 0.20(b) | 15.5 | Bal | 10 | 1.75 | 3.5 | 1.75 | 1.75 | 4.25 | 0.015 | 0.05 | 1.0(b) | — |
| NX188(c) (f) | 0.04 | — | — | — | Bal | — | 18 | — | — | — | 8 | — | — | — | — |
| Rene 41 | 0.09 | — | — | 19 | Bal | 11 | 10 | — | — | 3.1 | 1.5 | 0.010(b) | — | — | — |
| Rene 77(d) | 0.15(b) | — | — | 15 | Bal | 18.5 | 5.2 | — | — | 3.5 | 4.25 | 0.05(b) | — | 1.0(b) | — |
| Rene 80 | 0.17 | — | — | 14 | Bal | 9.5 | 4.0 | 4.0 | — | 5.0 | 3.0 | 0.015 | 0.03 | — | — |
| TRW 1800(c) | 0.09 | — | — | 13.0 | Bal | — | — | 9.0 | 1.5 | 0.6 | 6.0 | 0.07 | 0.07 | — | — |
| TRW 1900(c) | 0.11 | — | — | 10.3 | Bal | 10.0 | — | 9.0 | 1.5 | 1.0 | 6.3 | 0.03 | 0.10 | — | — |

TABLE 2

TYPICAL DISC ALLOYS (FOR CORE)

| Alloy (a) | C | Mn | Si | Cr | Ni | Co | Mo | W | Cb | Ti | Al | B | Zr | Fe | Other |
|---|---|---|---|---|---|---|---|---|---|---|---|---|---|---|---|
| | | | | Nominal Composition, % | | | | | | | | | | | |
| AF2-IDA | 0.35 | 0.1(b) | 0.1(b) | 12 | Bal | 10 | 3.0 | 6.0 | — | 3.0 | 4.6 | 0.015 | 0.10 | 0.5(b) | 1.5 Ta |
| Astroloy(d) | 0.06 | — | — | 15.0 | Bal | 15 | 5.25 | — | — | 3.5 | 4.4 | 0.03 | — | — | — |
| IN-100(c) | 0.18 | — | — | 10.0 | Bal | 15.0 | 3.0 | — | — | 4.7 | 5.5 | 0.014 | 0.06 | — | 1.0 V |
| Inconel 718 | 0.04 | 0.2 | 0.2 | 18.5 | 52.5 | — | 3.0 | — | 5.1 | 0.9 | 0.5 | — | — | 18.5 | 0.2 Cu |
| MAR-M211(c) | 0.15 | — | — | 9.0 | Bal | 10 | 2.5 | 5.5 | 2.7 | 2.0 | 5.0 | 0.015 | 0.05 | — | — |
| MAR-M246(c) | 0.15 | 0.10 | 0.05 | 9.0 | Bal | 10 | 2.5 | 10.0 | — | 1.5 | 5.5 | 0.015 | 0.05 | 0.15 | 1.5 Ta, 0.10 Cu(b) |
| Rene 85 | 0.27 | — | — | 9.3 | Bal | 15 | 3.25 | 5.35 | — | 3.25 | 5.25 | 0.015 | 0.03 | — | — |
| Rene 95 | 0.15 | — | — | 14 | Bal | 8.0 | 3.5 | 3.5 | 3.5 | 2.5 | 3.5 | 0.01 | 0.05 | — | — |
| Udimet 700(d) | 0.07 | — | — | 15 | Bal | 18.5 | 5.0 | — | — | 3.5 | 4.4 | 0.025 | — | 0.5(b) | — |
| Udimet 710 | 0.07 | 0.1(b) | 0.2(b) | 18 | Bal | 15 | 3.0 | 1.5 | — | 5.0 | 2.5 | 0.02 | — | 0.5(b) | — |
| Udimet 720 | 0.035 | — | — | 18.0 | Bal | 15.0 | 3.0 | 1.25 | — | 5.0 | 2.50 | 0.033 | 0.030 | — | — |
| Waspaloy B(g) | 0.07 | 0.75(b) | 0.75(b) | 19.5 | Bal | 13.5 | 4.3 | — | — | 3.0 | 1.4 | 0.006 | 0.07 | 2.0(b) | 0.10 Cu(b) |

(b)Maximum;
(c) Cast alloy;
(d) Compositions of Astroloy, Rene 77, and Udimet 700 are very similar. Certain elements are controlled to prevent sigma phase formation;
(f) Directionally solidified.

It will be appreciated that the alloys as enumerated in Tables 1 and 2 are provided by way of illustration and are not intended to be limiting of alternative satisfactory alloy compositions which can be employed to achieve the desired physical and chemical properties of the parts fabricated therefrom. Additionally, certain of the alloys of Tables 1 and 2 can also be interchangeably employed in the blade and hub sections depending upon the service conditions to which such turbine discs are to be subjected in order to achieve optimum performance and longevity.

Finely particulated powders of the alloy compositions as set forth in Tables 1 and 2 are commercially available from a variety of sources in a substantially pure state and at relatively minimal oxygen contents such as less than about 200 ppm. Such powders can conveniently be produced by any one of a variety of well-known processing techniques including the microcasting of a molten mass of the metal by gas atomization employing an inert gas to avoid contamination with oxygen. A process for the gas atomization of a molten mass of metal or metal alloy can conveniently be achieved utilizing apparatuses such as those described in U.S. Pat. No 3,253,783. As the particle size of a powder decreases, its total surface area increases which is associated by a corresponding increase in oxygen content. Since oxygen contamination in amounts in excess of about 200 ppm have been found in some instances to detract from the physical properties of the resultant compacted billet, it is generally preferred to employ powders in which the oxygen content is less than about 200 ppm.

The metal or metal alloy powders employed are selected such that the average particle size ranges up to about 250 microns to a size as small as about 1 micron. Generally, for superalloy powders, it is preferred that the average particle size is controlled within a range of from about 150 microns to about 10 microns with the particles distributed randomly over the aforementioned range in order to attain maximum packing density of the powder within the compaction container. The loose packing density of the powder prior to hot compaction will generally range from about 60 percent to about 70 percent of 100 percent theoretical density. When the billet is to be employed for fabricating gas turbine discs, it may be desired that the powder particles of the alloy employed for the peripheral blade section of the billet be of a relatively larger average particle size while smaller particle sizes are employed for the core section to achieve a composite billet having the optimum microstructure.

In accordance with one embodiment of the process comprising the present invention and with reference to FIG. 1 of the drawings, an arrangement is illustrated for effecting a preliminary compaction of a first alloy powder composition into a densified tubular mass having a central bore therethrough. As shown, a metal powder indicated at 10 is filled within a circular cylindrical container having a circular outer wall 12, a circular concentric inner wall 14, an annular bottom wall 16, and an annular top wall 18 which is provided with a filler tube 20 for introducing the powder 10 into the interior thereof. The container is comprised of a ductile gas-impervious material of which mild steel or stainless steels are typical and preferred. The several walls defining the container assembly are suitably joined together such as by welding to define an annular tubular chamber in which the powder 10 is confined. The powder 10 is filled and loosely packed in the container through the filler tube 20 and the filling operation is preferably performed under vacuum. After the container is filled, the filler tube 20 can be crimped or otherwise deformed or welded to assure a gas-tight seal. The loose packing density of the metal powder can be enhanced by subjecting the container to vibration during the filling operation in order to achieve a loose packing density generally in the order of about 60 to about 70 percent of 100 percent theoretical density.

The powder-filled container as illustrated in FIG. 1 is thereafter placed in an autoclave in which it is heated and subjected to an external pressure for a period of time sufficient to effect a hot isostatic compaction thereof to provide a density of the powder of at least about 96 percent, and preferably of at least about 99 percent of 100 percent theoretical density. For conventional superalloy powders, a preheating temperature of from about 1,850° up to about 2,250° F. is employed at pressures of at least about 1,000 psi up to a pressure of about 30,000 psi or higher depending upon the strength limitations of the autoclave employed. Under the foregoing temperature conditions and employing pressures of about 15,000 to about 30,000 psi, a hot isostatic compaction of the powder in the container can be effected to achieve a density in excess of at least 99 percent up to and including 100 percent theoretical density.

It will be appreciated that the specific temperature and pressure employed as well as the duration of the hot isostatic compaction step will vary upon the particular composition, particle size, and configuration of the powder employed. Variations in the specific conditions utilized can be made to achieve optimum compaction and physical characteristics of the resultant compacted tubular mass.

Figure 2:
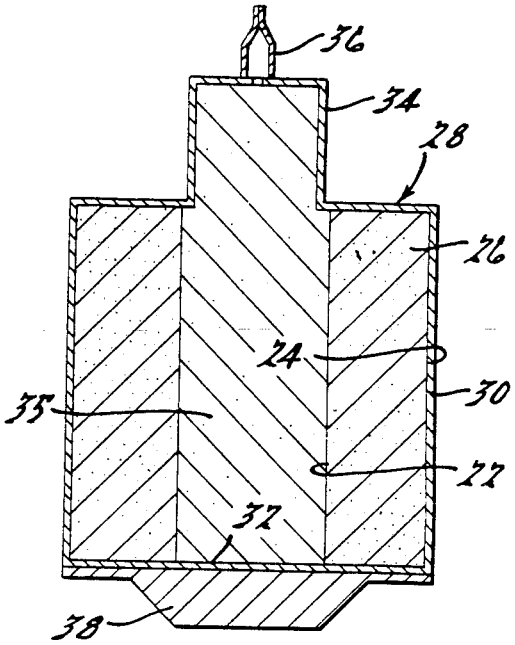
FIG. 2 is a transverse vertical sectional view of a second container containing the compacted tubular billet and having the axial central core thereof filled with a second alloy powder of a different composition.

At the completion of the hot isostatic compaction step, at least a portion of the container is removed from the exterior of the compacted tubular mass and preferably, both the inner core surface indicated at 22 in FIG. 2 and the outer perhipheral surface indicated at 24 in FIG. 2 are machined or otherwise finished to desired dimensions. In this regard, the initial dimensions of the container employed as shown in FIG. 1 are sized in consideration of the axial and radial compaction of the container and the powder contents to produce a densified tubular mass indicated at 26 in FIG. 2 which requires only minimal finishing operations to achieve the proper dimensions.

While it is generally desired to remove the entire metal container from the surface of the densified tubular mass, it is also contemplated that only the inner wall 14 can be removed and the inner surface 22 finished leaving the outer wall 12, annular bottom wall 16 and annular top wall 18 of the container intact to which supplemental sections can be added and sealed such as by welding to form a second container indicated at 28 in FIG. 2. The second container 28 as shown in FIG. 2 similarly comprises a circular outer wall 30, a circular bottom wall 32, and an annular hat-shaped section top wall 34 having a deformable filler tube 36 attached to the central upper portion thereof.

The assembly as illustrated in FIG. 2 is prepared with the top wall 34 removed such that the tubular mass 26 can be inserted within the container whereafter the top wall is attached such as by welding in sealing relationship thereover. A powder of a desired second alloy composition 35 is thereafter filled within the internal core defined by the inner core surface 22 in a manner as previously described in connection with FIG. 1 to a loose packing density of about 60 percent to about 70 percent of 100 percent theoretical density. Following the filling operation, the filler tube 36 is crimped and sealed. The second container 28 as shown in FIG. 2 is adapted for ultimate extrusion of the powder contents and for this purpose, a tapered nose section 38 is preferably affixed to the outer face of the bottom wall 32 at this stage or shortly prior to the extrusion step. The tapered nose section facilitates axial orientation of the container with the extrusion die orifice during the extrusion step. It will be appreciated that extrusion of the container can also be preformed without using a tapered nose section.

Figure 3:
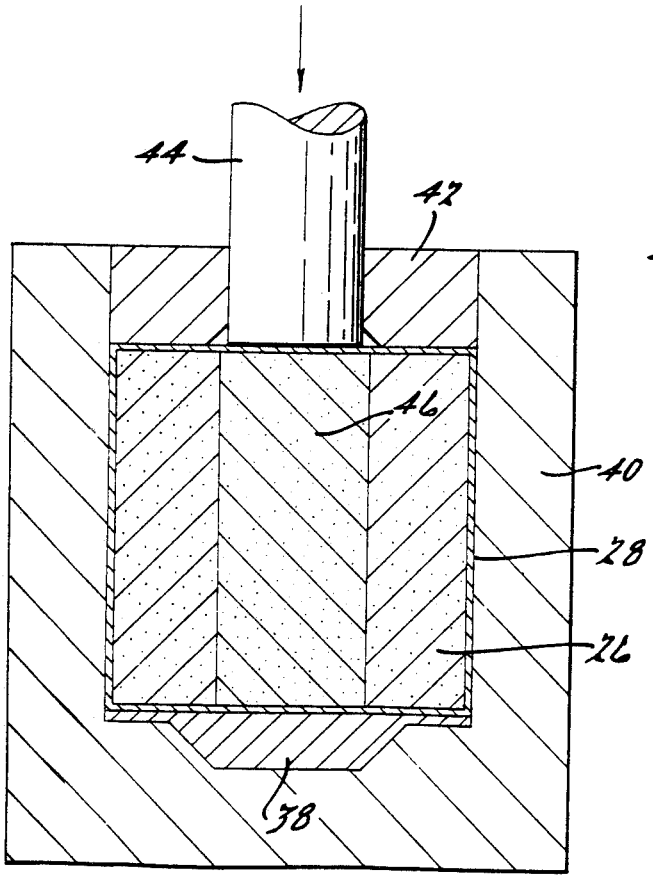
FIG. 3 is a fragmentary vertical sectional view of a die arrangement in which the second alloy powder in the container as shown in FIG. 2 is compacted by ram compaction to substantially 100 percent theoretical density within the central core of the outer tubular billet.

The filled and sealed container as illustrated in FIG. 2 is next reheated to temperatures within the general range employed during the prior hot isostatic compaction step and is placed in a die 40 as shown in FIG. 3 having a cavity conforming to the peripheral side and bottom dimensions of the container 28. An annular retainer ring 42 is placed over the upper shouldered portion of the container whereafter a cylindrical ram 44 effects compaction of the second alloy powder 35 into a preliminarily densified central cylindrical core 46. Compaction of the powder 35 within the central bore of the tubular mass 26 can be performed by employing alternative compaction techniques including modified ram compaction to achieve a densification of the second alloy powder to a density of at least about 98 percent of theoretical density and preferably a densification approaching 100 percent of theoretical density.

Following the compaction step, the container 28 and the composite compacted powder contents thereof are removed from the die 40 and is subjected to reheating within a temperature range similar to that employed in the prior hot isostatic pressing and ram compaction steps whereafter the container is extruded through an extrusion die with the tapered nose section 38 positioned adjacent to the die orifice. The extrusion step is carried out at an extrusion ratio generally of at least about 3:1 up to as high as about 10:1. The extrusion ratio as herein employed is defined as the original cross-sectional area divided by the final cross-sectional area of the resultant composite billet which is of substantially 100 percent theoretical density and which is possessed of the desired wrought-grain structure. The extrusion of the preliminary compacted composite powder billet can most conveniently be achieved in a single pass extrusion step although it is also contemplated that multiple passes can be employed, if desired or required, to attain the desired reduction in the cross-sectional area and the optimum peripheral dimension of the resultant billet.

Figure 4:
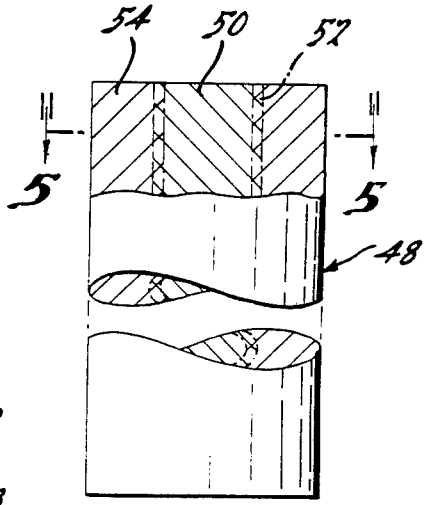
FIG. 4 is a fragmenary elevational view partly in section of a composite billet produced by the extrusion of the container and compacted powders produced in accordance with FIG. 3.
Figure 5:
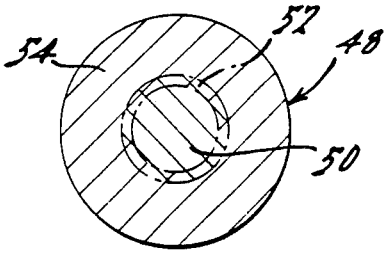
FIG. 5 is a transverse cross-sectional view of the concentric relationship of the outer annular alloy layer relative to the central alloy core of the composite billet.

At the completion of the extrusion step, the nose section and the container 28 is removed from the periphery of the composite billet and the exterior surface thereof can be subjected to further finishing operations to produce an elongated composite billet illustrated at 48 in FIGS. 4 and 5. The composite billet 48 is characterized as comprising an axially extending central core 50 metallurgically bonded along an annular interface indicated at 52 to an outer peripheral layer 54 which is disposed substantially concentric to the center of the core. The concentricity of the outer layer relative to the core center is an important feature of the present invention in that the uniform disposition of the first alloy composition of the outer layer 54 relative to the second alloy composition comprising the central core 50 enables an optimum transition of the physical and chemical properties of which the two sections are comprised in the fabrication of rotary components such as gas turbine discs assuring an accurate transition from one alloy composition to the second alloy composition on moving from the hub section to the blade section of the final machined turbine disc.

The resultant billet can be sectioned axially into a series of circular discs which can thereafter be postformed and/or machined to the desired configuration and dimensions in accordance with practices well known in the art.

In accordance with an alternative embodiment of the process comprising the present invention, the tubular mass 26 is produced by hot extrusion over a solid mandrel to effect substantially complete densification of the metal powder in the tubular container to form an elongated tubular billet. For this purpose, a tubular container similar to that shown in FIG. 1 is employed having a central bore adapted to slideably receive the solid mandrel and sized so as to correspond to the axial bore of the inner core surface 22 of the tubular billet 26 illustrated in FIG. 2. The outer diameter of the tubular container shown in FIG. 1 is increased to compensate for an extrusion of the tubular container and metal powder contents at an extrusion ratio generally of at least about 3:1 up to as high as to about 10:1 under the same conditions as previously described in connection with the extrusion of the second container 28 illustrated in FIG. 3. The extrusion die orifice diameter is appropriately sized such that the resultant tubular billet is of an appropriate diameter to be placed within the interior of the outer wall 30 of the second container 28 in accordance with the arrangement illustrated in FIG. 2. When the tubular mass 26 is produced by hot extrusion, it is contemplated that the elongated tubular mass can be cut into sections of an appropriate length to be received within the second container 28. As in the case of the extrusion of the second container, a nose plug 38 is desirably employed formed with an appropriate central bore for slidably receiving the solid extrusion mandrel.

The utilization of the hot extrusion technique for producing the tubular mass 26 constitutes a preferred practice for large volume production as opposed to hot isostatic pressing. The subsequent sequence of steps and process parameters employed are identical for producing a composite billet to those previously described in which the tubular mass was produced by hot isostatic pressing and as illustrated in FIGS. 2 and 3 of the drawing.

In order to further illustrate the process of the present invention, the following example is provided. It will be understood that the example is provided for illustrative purposes and is not intended to be limiting of the scope of the present invention as herein described and as set forth in the subjoined claims.

EXAMPLE

A composite billet comprised of two different superalloys is produced employing powder metallurgical techniques by providing an annular container having a central bore therethrough comprised of a mild steel. The interior of the container as shown in FIG. 1 is filled with a Lo C Astroloy superalloy powder having a particle size of minus 140 mesh (U.S. Standard) to achieve a loose packing density of about 65 percent of 100 percent theoretical density. The filling operation is performed under vacuum and the powder has a maximum oxygen content of 100 ppm.

The filled container is thereafter heated in an autoclave to a temperature of 2050° F. whereafter it is subjected to hot isostatic pressing under a pressure of 15,000 psi for a period of 120 minutes.

Following the hot isostatic compaction step, the compacted mass of 100% density is permitted to cool and the container is removed from the exterior surfaces thereof and the peripheral surface of the compacted powder mass and the inner core as well as the end faces of the mass are machined to provide a tubular mass having an outer diameter of 6.75 inches, an inner core diameter of 4.75 inches, and an axial length of 5.38 inches.

The resultant tubular mass is placed in a second container providing a close-fitting relationship between the outer periphery of the tubular mass and a top plate such as the top plate 34 illustrated in FIG. 2 is subsequently attached thereto. A second alloy powder comprising Rene 95 of the type listed in Table 2 is inserted and filled into the central core of the tubular mass through a filler tube under a vacuum of 10 microns and under vibration to provide a loose packing density of about 62 percent of 100 percent theoretical density. The second alloy powder has a particle size of minus 140 mesh and an oxygen content of about 100 ppm. Following the filling operation, the filler tube is sealed by welding and a nose plug is affixed to the bottom wall of the container. The container is heated in a box furnace to a temperature of about 1960° F. whereafter it is placed in a die assembly of the type illustrated in FIG. 3 and the central uncompacted powder core section is ram compacted under a pressure of 35 to 38 tons per square inch to a density of about 97 percent of 100 percent theoretical density without effecting any significant deformation or distortion of the tubular compacted mass.

The resultant preliminarily compacted composite mass is reheated to a temperature of about 1990° F. and is thereafter extruded in a single pass at an extrusion ratio of about 6:1. Following the extrusion step, the container is removed from the periphery of the billet producing an elongated billet of a nominal exterior diameter of 3 inches and a length of about 2 feet.

An inspection of the cross-sectional metallurgical characteristics of the resultant billet reveals that the first alloy composition is of an annular thickness of about ½ inch and is uniformly and metallurgically bonded to the second alloy comprising the central core which is of a nominal diameter of about 2 inches. The circular diffusion bond at the interface of the two alloy compositions is substantially concentric to the center of the billet.

An inspection of the microstructure of the composite billet reveals a normal extruded microstructure for both alloys which are of 100 percent density. The bond between the outer Lo C Astroloy alloy layer and the inner core of Rene 95 alloy was clean and free of debris. The location of the annular bond line was predictable and uniform along the length of the extruded billet.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

What is claimed is:

1. A process for making a composite billet comprising an outer annular cylinder of a first alloy composition and an inner cylindrical core of a second alloy composition metallurgically bonded together as an integral densified mass comprising the steps of:

(1) confining a first metal powder of a first alloy composition in an annular cylindrical container having an axial bore therethrough, (2) sealing and hot compacting the container and metal powder into a densified tubular mass having a centrally extending interior bore, (3) separating the container from at least the interior bore of the tubular mass and finishing the interior bore surface to prescribed dimensions, (4) enclosing the tubular mass in a second container and filling said interior bore with a second metal powder of a second alloy composition, (5) sealing and hot compacting the container and second metal powder without significant distortion of said tubular mass, (6) heating and extruding said container and said first and second metal powder therein through a die of reduced cross-sectional area effecting further densification and elongation thereof into an integral composite billet, and (7) thereafter removing the second container from the periphery of said composite billet.

2. The process as defined in claim 1 in which the particle size of said first metal powder and said second metal powder ranges from about 1 up to about 250 microns.

3. The process as defined in claim 1 in which the particle size of said first metal powder and said second metal powder ranges from about 10 to about 150 microns.

4. The process as defined in claim 1 in which said first metal powder and said second metal powder comprise a superalloy.

5. The process as defined in claim 1 in which step (1) and step (4) are performed to provide a loose packing density of the metal powder ranging from about 60 percent to about 70 percent of 100 percent theoretical density.

6. The process as defined in claim 1 in which step (2) is performed to provide a densified tubular mass of at least about 96 percent of 100 percent theoretical density.

7. The process as defined in claim 1 in which step (2) is performed to provide a densified tubular mass of at least about 99 percent of 100 percent theoretical density.

8. The process as defined in claim 1 in which step (2) is performed by hot isostatic pressing.

9. The process as defined in claim 8 in which step (2) is performed to provide a pressure of about 1,000 to about 30,000 psi during the hot isostatically pressing step.

10. The process as defined in claim 1 in which step (2) is performed by hot extrusion of the annular cylindrical container over a mandrel at an extrusion ratio of about 3:1 up to about 10:1.

11. The process as defined in claim 1 in which step (6) is performed to provide an extrusion ratio of about 3:1 up to about 10:1.

12. The process as defined in claim 4 in which steps (2), (5), and (6) are performed at a temperature of about 1,850° to about 2,250° F.

13. A composite billet produced in accordance with the process as defined in claim 1.

* * * * *